US006029770A

United States Patent [19]

Schneider et al.

[11] Patent Number: 6,029,770

[45] Date of Patent: Feb. 29, 2000

[54] SOUND DAMPING ELEMENT

[75] Inventors: Arnold Schneider, Frankenthal; Stefan Debold, Ludwigshafen, both of Germany

[73] Assignee: Wendt Sit GmbH, Ludwigshafen, Germany

[21] Appl. No.: 09/119,003

[22] Filed: Jul. 20, 1998

[51] Int. Cl.[7] ..... E04B 1/00

[52] U.S. Cl. ..... 181/285; 181/287; 181/290

[58] Field of Search ..... 181/284, 285, 181/286, 287, 288, 290, 296, 210; 52/272, 284, 288, 582, 584, 144, 145

[56] References Cited

U.S. PATENT DOCUMENTS 4,038,796 8/1977 Eckel ..... 52/584
5,260,525 11/1993 Morse ..... 181/285

FOREIGN PATENT DOCUMENTS 4414201 9/1995 Germany .

*Primary Examiner*—Khanh Dang
*Attorney, Agent, or Firm*—Evenson, McKeown, Edwards & Lenahan, P.L.L.C.

[57] ABSTRACT

A sound damping element contains an inner wall and an outer wall, between which a cavity filled with absorption material is present, which are joined to one another. At longitudinal edges of the element, bent-away profile portions are disposed so that a junction with a similarly configured adjacent sound damping element can be made. The sound damping element is to be improved such that, with low production and material cost, a seal for preventing gas from passing through the element is achieved. Easy manipulation in assembly is possible, and the individual sound damping elements can be joined together without problems and, if necessary, separated from one another. At least one profile portion has a section such that at least a portion of a chamber is formed. At least in the portion of this chamber, a sealing element is disposed. Sealing is accomplished by this sealing element with respect to the adjacent second sound damping element.

20 Claims, 2 Drawing Sheets

SOUND DAMPING ELEMENT

BACKGROUND OF THE INVENTION

1. Field of the Invention

This invention relates to a sound damping element containing an inner wall and an outer wall between which a cavity fitted with absorption material is present and which are joined to one another. Bent profiles are disposed at longitudinal edges so that a junction can be made with a similarly configured adjacent sound damping element.

2. Description of Related Art

German Patent DE 44 14 201 C1 discloses a sound damping element which has an outer wall and an inner wall, between which there is a cavity filled with sound absorbing material. The outer wall and the inner wall are connected to one another, and profile portions are on the longitudinal edges. A connection is made with adjacent sound damping elements by the profile portions. Also, the profile portions are configured for an especially interlocking joining of the outer wall and inner wall. These sound damping elements are used chiefly for noise blocking in buildings, cabs, walls or the like. The absorption material in the cavity is for example mineral fibers or plastic foam, while the inner wall associated with the sound source contains openings to admit sound. Adjacent sound damping elements disposed side by side are joined together tensionally and/or interlocked. The passage of gas, such as $CO_2$, through a wall or the like which is made up of such sound damping elements, is not easy to prevent.

SUMMARY OF THE INVENTION

This invention therefore addresses the problem of improving the sound damping element such that a seal for preventing the passage of gas is achieved with little material and manufacturing expense. The sound damping element is to have a functionally reliable design and is to be easy to handle for assembly, and the sound damping elements are to be joined together and disassembled easily and without special tools or aids.

The solution of this problem is accomplished by providing at least one profile portion with a section such that at least a portion of a chamber is formed and disposing a sealing element in a portion of the chamber so that sealing is made with respect to an adjacent second sound damping element.

The sound damping element according to the invention has a functional construction and contains, on at least one longitudinal edge, a sealing element which assures against the passage of gases to the adjacent sound damping element or the like. The angled profile portions are configured such that, between adjacent sound damping elements, a chamber is present to accommodate the sealing element which is in sealing contact with the profile portions of the adjacent sound damping elements.

Further developments and special features of the invention are clear from the following description and from the drawings.

DESCRIPTION OF THE PREFERRED EMBODIMENTS

Figure 1:
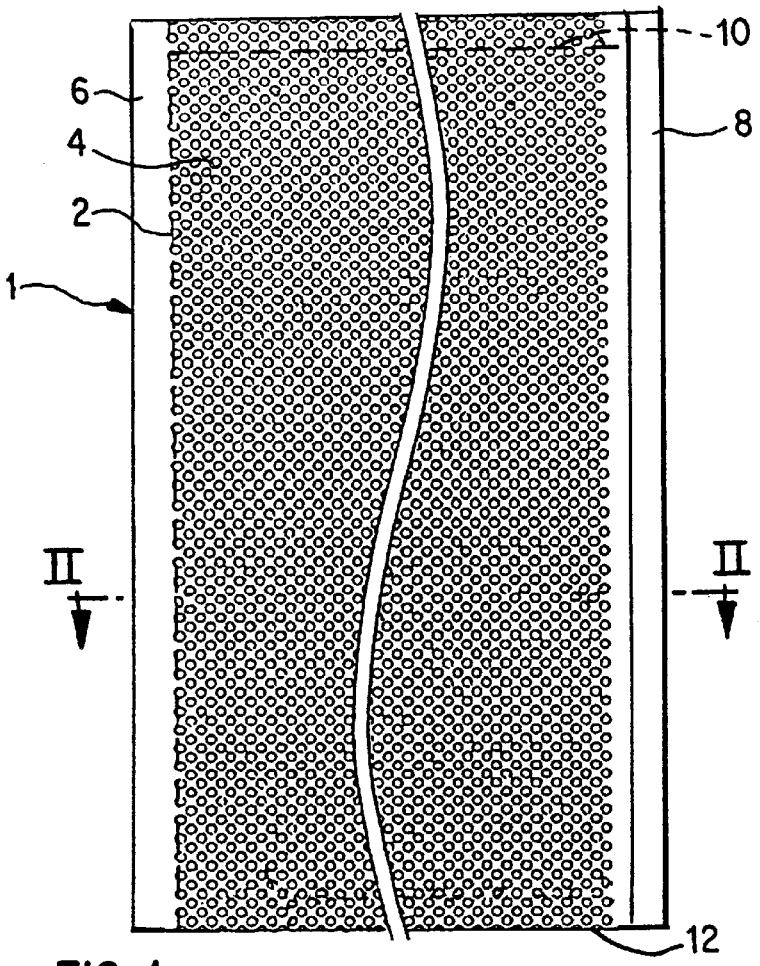
FIG. 1 is an overall view of the sound damping element of the invention.

FIG. 1 is a view of the sound damping element 1 with an inner wall 2 which has perforations 4 and profile portions 6 and 8 disposed at its longitudinal edges. The perforations 4 do not extend over the entire width of the sound damping element 1, which for the sake of simplicity will also be referred to hereinafter as the damping element, but terminate at a given distance from the lateral profile portions 6 and 8. In this manner the bending away of the profile portions 6 and 8, to be explained hereinafter, is made easier by the fact that the width dimension of the damping element 1 is held to low manufacturing tolerances and low manufacturing cost. If the perforations were also to extend into the range of the long edge, relatively great dimensional differences might result when the bending is performed. Between the outer wall behind the plane of drawing and the inner wall 2, connecting elements 10 and 12 are provided at the upper and lower ends, respectively, which are especially configured as sheet-metal connectors and close off the ends of the inner cavity filled with absorption material.

Figure 2:
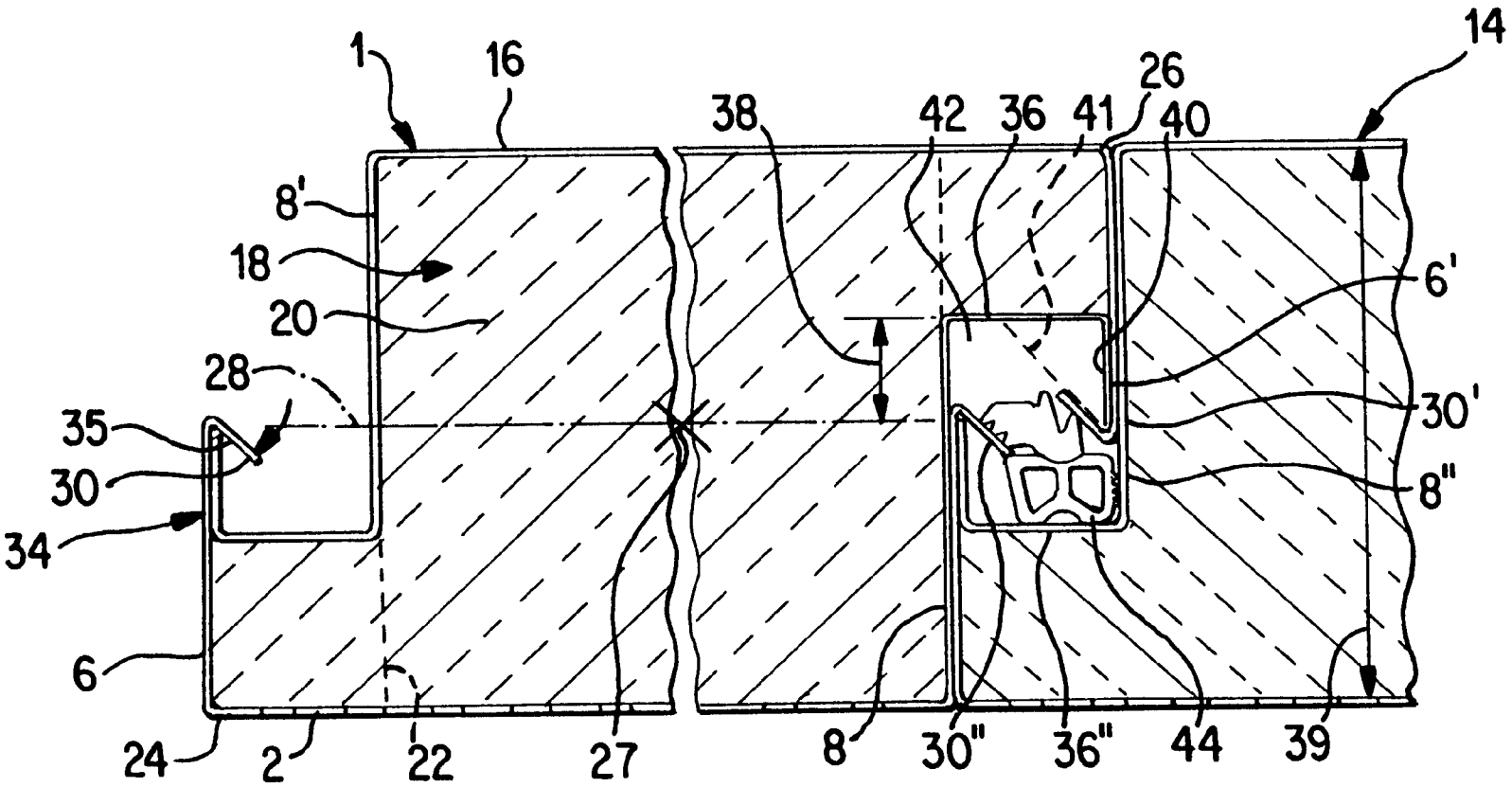
FIG. 2 is an enlarged view in a horizontal plane, along section line II—II of FIG. 1, through two sound damping elements placed side by side.

FIG. 2 shows a section along line II—II of FIG. 1 through the sound damping element 1, as well as an additional sound damping element 14 of the same configuration, which is disposed laterally beside the first sound damping element 1. The cavity 18 present between the inner wall 2 and the outer wall 16 is filled with absorption material 20 which consists of mineral fibers, plastic foam or the like. As indicated by broken lines 22, the absorption material can be omitted in the area of the lateral longitudinal edges 24 and 26. In such a configuration, the absorption material has a substantially rectangular cross-sectional area and it can thus be configured, without any special pattern or measures, as a board of rectangular cross section and disposed in the cavity 18.

The lateral profile portions 6 and 8 are suitably bent at least approximately at a right angle to the plane of the inner wall 2. The outer wall 16 also has correspondingly bent profile portions 6' and 8'. Except for the perforations 4 in the inner wall 2, the cross section of the outer wall 16 is the same as that of the inner wall 2. The outer wall 16 is rotated 180° with respect to the central longitudinal axis 27 orthogonal to the plane of drawing. The following explanations concerning the inner wall 2 and its bent profile portions 6 and 8 apply correspondingly also to the outer wall 16 and its bent profile portions 6' and 8'. The bent profile portion 6 of the inner wall 2 has a portion 30 at the central plane 28 of the damping element 1 which is pointed toward the inner wall 2 and forms with profile portion 6 a preferably acute angle 34, especially of the order of 45°, an inner connecting portion 35 being present. The profile portion 6 is arranged at least approximately at a right angle to the inner wall 2, and the inner connecting portion 35 opens toward the inner wall 2. The other profile portion 8 of the inner wall 2 is likewise bent at least approximately at a right angle away from the plane of the inner wall 2, and furthermore contains a second bent section 36 which is disposed at a given distance 38 from the central plane on the side opposite the inner wall 2. The second section 36 is disposed substantially parallel to the inner wall 2. The depth 39 of the damping element 1 is established by the distance between the inner wall 2 and outer wall 16 which are parallel to one another. With its third portion 40 the section 36 reaches into the internal junction between profile portion 6' and the bent-away portion 30' of the outer wall 16. Section 36, which is substantially parallel to the inner wall 2, is at a distance from the latter which, according to the invention, is greater than one-half the depth 39 of the damping element 1. The second section 36 is preferably at a right angle to profile portion 8 and has such a width that it reaches the first profile portion 6' of the outer wall 16.

The second section 36 is preferably adjoined by a third portion 40 which contacts the profile portion 6' of the outer wall 16 and reaches as far as the bent-away portion 30' of the latter. These portions produce a form-fitting junction of the profile portions 8 of the inner wall 2 and the profile portion 6' at the longitudinal edge 26. In a corresponding manner a form-fitting junction is produced along the longitudinal edge 24 on the left in the drawing between the profile portions 6 and 8' of the inner wall 2 and outer wall 16. By means of the initially explained connecting elements provided between the inner wall 2 and the outer wall 16, a tight junction between the inner wall 2 and the outer wall 16 is assured.

An alternative embodiment is represented with a broken line 41. In this alternative, instead of the section 36 being bent at right angles relative to the profile portion 8, the second portion is bent back on itself and, with its free end, directly enters into the inner junction area between the first profile portion 6' and the acute-angle section 30'. As it is apparent, even in this alternative embodiment, a tensional and/or formfitting junction is made between the inner wall and the outer wall 6.

Thus, due to the arrangement of the sections according to the invention, a chamber is present between the adjacent damping elements directly joined at their longitudinal edges. The chamber has a depth which is twice as great as the distance 38 of the second section 36 from the central plane 28 mentioned above. As measured parallel to the central plane 28, the chamber 42 has a width corresponding to the length of the second section 36 measured in the same direction. Since the section 36 is arranged at right angles to the profile portion 8, the chamber 2 has an at least approximately rectangular cross section. As can be seen, the sections 30 and 30', respectively, of the second sound damping element 14 and first sound damping element 1 reach into the chamber 42. A sealing element 44 is provided in the chamber 42 according to the invention so that the passage of gas is blocked at the junction between the adjacent sound damping elements 1 and 14. The sealing element 44 appropriately contains sealing lips. The sealing element 44 is in sealing contact both with the first sound damping element and also with the second sound damping element 14, especially at their bent sections 30' and 30. As is apparent, chamber 42 is defined partially by the profile portion 8 and the second section 6 of the inner wall 2 of the first damping element and also by the profile portion 8" and its bent section 36". The first section 30' bent at an acute angle to the outer wall 16 of the first damping element 1 and correspondingly the first angled section 30" of the second damping element 16 extend into the interior of the chamber 42. The sealing element 44 likewise is in contact with the sections 30' and 30", definitely locking and securing it within the chamber 42. Appropriately, the sealing element 44 is held securely by the first section 30" in the second damping element 14 even before the assembly of the adjacent damping elements. The assembly of adjacent damping elements can thus be performed without problems and without the need to fear shifting or escape of the sealing element 44 from its correct position.

Figure 3:
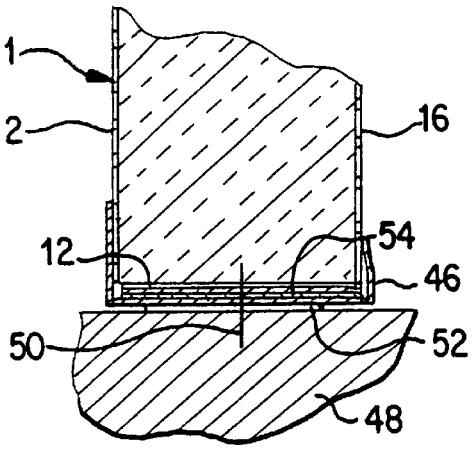
FIG. 3 is a sectional view along a vertical plane through a bottom end of the sound damping element together with a bottom profile portion.

FIG. 3 shows in a vertical section plane a section through the bottom end of the sound damping element 1, which is inserted in a preferred manner into a channel-shaped bottom profile 46. The bottom profile 46 is fastened to the floor 48 of a building or the like, by screws and plugs, as is indicated by the line 50. Between the floor 48 and the bottom profile 46 there is a sealing profile 52 so as to assure a gas-tight junction in this area as well. For the same reason, another sealing profile 54 is provided between the bottom profile 46 and the sound damping element 1 and its joining element 12. The joining element 12 forms the bottom closure of the sound damping element 1 and is substantially flush with the bottom ends of the perforated inner wall 2 and the unperforated outer wall 16.

Figure 4:
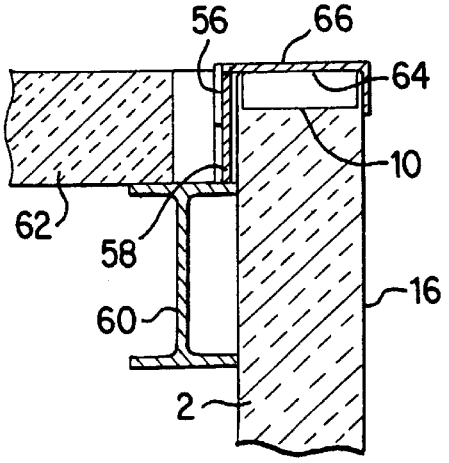
FIG. 4 is a sectional view along a vertical plane through an upper end of the sound damping element.

FIG. 4 is a vertical section through the upper end of the sound damping element 1 with the connecting element 10 between the inner wall 2 and outer wall 16. The sound damping element 1 has a holding body 56 which engages a bearing element 58. The bearing element 58 is mounted on a beam 60 on which rests a horizontal sound damping element 62. This sound damping element 62 is substantially horizontal and forms a component of a roof. The element 62 is configured otherwise the same as the vertically disposed, wall-forming sound damping elements explained above. Lastly, at the upper end of the sound damping element 1, there is provided a sealing profile 64 over which a downwardly bent cover plate 66 is disposed, so that gas-tightness is also assured in this area.

To assemble a vertical wall from the sound damping elements, the latter are inserted at the bottom as shown in FIG. 3 into the floor channel 46 extending over the entire width of the wall, and the suspension of the elements in the upper bearing element 58 is performed by the holding body 56 described in connection with FIG. 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Sound damping element comprising:

an inner wall and an outer wall joined to one another and defining a cavity therebetween, absorption material present within said cavity, bent profile portions connected to each of the inner and outer walls at longitudinal edges of the element by which a junction can be made with a similarly configured adjacent sound damping element, at least one of said bent profile portions having a section forming at least a portion of a chamber, and a sealing element disposed in the portion of the chamber to provide sealing at said junction with the similarly configured adjacent sound damping element, the chamber in which the sealing element is disposed being located between the section of the at least one of said bent profile portions and an additional section of an additional bent profile portion of the similarly configured adjacent sound damping element.

2. Sound damping element according to claim 1, wherein the section of the at least one of said bent profile portions is located at a distance from the inner wall and from the outer wall which is greater than one-half of a depth of the sound damping element corresponding to a distance between the inner wall and the outer wall.

3. Sound damping element according to claim 1, wherein the at least one of the bent profile portions and the section forming at least a portion of a chamber are formed in one piece and of sheet metal.

4. Sound damping element according to claim 1, wherein the at least one and the additional bent profile portions overlap with respect to a central plane such that the chamber is present between the sound damping element and the similarly configured adjacent sound damping element.

5. Sound damping element according to claim 1, wherein each of the bent profile portions is disposed substantially at a right angle to one of the inner and outer walls and wherein corresponding bent profile portions of the at least one and the additional sound damping elements lie substantially sealingly against one another.

6. Sound damping element according to claim 1, wherein the at least one of said bent profile portions is bent away from the inner wall and extends to a given distance beyond a central plane.

7. Sound damping element according to claim 1, wherein the section of the at least one of said bent profile portions is disposed substantially parallel to said inner wall.

8. Sound damping element according to claim 1, wherein the section of the at least one of said bent profile portions is disposed substantially parallel to said outer wall.

9. Sound damping element according to claim 1, wherein the absorption material is also provided in an internal volume located between the section forming at least a portion of the chamber and one of the inner and outer walls.

10. Sound damping element comprising:

an inner wall and an outer wall joined to one another and defining a cavity therebetween, absorption material present within said cavity, bent profile portions connected to each of the inner and outer walls at longitudinal edges of the element by which a junction can be made with a similarly configured adjacent sound damping element, at least one of said bent profile portions having a section forming at least a portion of a chamber, a first of said bent profile portions defined on the inner wall containing a first section which is bent at an acute angle toward the inner wall, a sealing element disposed in the portion of the chamber to provide sealing at said junction with the similarly configured adjacent sound damping element, and an inner connecting portion provided between the first of said bent profile portions and the first section, in which a second section of a second of said bent profile portions of the outer wall engages.

11. Sound damping element according to claim 10, wherein the first section which is bent at an acute angle enters into the portion of the chamber in which the sealing element is disposed.

12. Sound damping element according to claim 10, wherein the sealing element is held, at least in one portion of the sound damping element, by the first section which is bent at an acute angle.

13. Sound damping element according to claim 10, wherein the sealing element is in sealing contact with first sections of the sound damping element and the similarly configured adjacent sound damping element.

14. Sound damping element comprising:

an inner wall and an outer wall coined to one another and defining a cavity therebetween, absorption material present within said cavity, bent profile portions connected to each of the inner and outer walls at longitudinal edges of the element by which a junction can be made with a similarly configured adjacent sound damping element, at least one of said bent profile portions having a section forming at least a portion of a chamber, a first of said bent profile portions defined on the outer wall containing a first section which is bent at an acute angle toward the outer wall, a sealing element disposed in the portion of the chamber to provide sealing at said junction with the similarly configured adjacent sound damping element, and an inner connecting portion provided between the first of said bent profile portions and the first section, in which a second section of a second of said bent profile portions of the inner wall engages.

15. Sound damping element according to claim 14, wherein the first section which is bent at an acute angle enters into the portion of the chamber in which the sealing element is disposed.

16. Sound damping element according to claim 14, wherein the sealing element is held, at least in one portion of the sound damping element, by the first section which is bent at an acute angle.

17. Sound damping element according to claim 14, wherein the sealing element is in sealing contact with first sections of side by side sound damping elements.

18. Sound damping element comprising:

an inner wall and an outer wall joined to one another and defining a cavity therebetween, absorption material present within said cavity, bent profile portions connected to each of the inner and outer walls at longitudinal edges of the element by which a junction can be made with a similarly configured adjacent sound damping element, at least one of said bent profile portions having a section forming at least a portion of a chamber, and a sealing element disposed in the portion of the chamber to provide sealing at said junction with the similarly configured adjacent sound damping element, wherein the section of the at least one of said bent profile portions is turned away from the cavity of the sound damping element.

19. Sound damping element according to claim 18, wherein the section of the at least one of said bent profile portions is disposed substantially parallel to said inner wall.

20. Sound damping element according to claim 18, wherein the section of the at least one of said bent profile portions is disposed substantially parallel to said outer wall.

* * * * *